US005740492A

United States Patent [19]

Deki et al.

[11] Patent Number: 5,740,492

[45] Date of Patent: Apr. 14, 1998

[54] COLOR IMAGE FORMING APPARATUS

[75] Inventors: Tsuyoshi Deki, Koshigaya; Takahiro Tamiya; Koichi Irie, both of Tokyo, all of Japan

[73] Assignee: Ricoh Company, Ltd., Tokyo, Japan

[21] Appl. No.: 652,159

[22] Filed: May 23, 1996

[30] Foreign Application Priority Data

May 26, 1995 [JP] Japan ..... 7-152392
Jun. 9, 1995 [JP] Japan ..... 7-168227

[51] Int. Cl.[6] ..... G03G 15/16

[52] U.S. Cl. ..... 399/66; 399/301; 399/302

[58] Field of Search ..... 399/301, 302, 399/66, 51; 347/116, 153, 154

[56] References Cited

U.S. PATENT DOCUMENTS

| | | | |
|---|---|---|---|
| 5,255,063 | 10/1993 | Ideyama et al. | 399/301 |
| 5,270,769 | 12/1993 | Satoh et al. | 399/301 |
| 5,300,982 | 4/1994 | Inamoto et al. | 399/301 |
| 5,452,073 | 9/1995 | Kataoka | 399/299 |
| 5,499,092 | 3/1996 | Sasaki | 399/302 |
| 5,515,145 | 5/1996 | Sasaki et al. | 399/302 |

*Primary Examiner*—Matthew S. Smith
*Attorney, Agent, or Firm*—Oblon, Spivak, McClelland, Maier & Neustadt, P.C.

[57] ABSTRACT

A color image forming apparatus is provided with an intermediate transfer belt to transfer thereupon an image of each of a plurality of colors carried on a photoconductive member, sequentially superposing one image on top of another, to form a full color image, and to further transfer the full color image to a copysheet. The intermediate transfer belt is passed over supporting rollers and a plurality of marks are printed on the intermediate transfer belt for indicating a position on the belt. A detector is provided for detecting the marks on the belt to generate a detect signal to start an image forming operation for each of the colors. The detector is controlled to start detection of a mark when a predetermined length of time is elapsed after a start or a termination of an operation of a driving element of the apparatus. The detector is provided at a position facing one of the support rollers around which the intermediate transfer belt is passed. A distance between the adjoining marks is equal to an integral multiple of at least one of a circumference of the roller the detector faces. The provision of an improved color image forming apparatus realizes a capability of accomplishing an accurate image registration for each of the plurality of colors.

21 Claims, 11 Drawing Sheets

END: MARK RECOGNITION

COLOR IMAGE FORMING APPARATUS

BACKGROUND OF THE INVENTION

1. Field of the Invention

The present invention relates to an improved color image forming apparatus provided with an intermediate transfer member to sequentially transfer thereupon images for each of a plurality of colors which are carried on a photoconductor, superposing one image on top of another to form a full color image for further transfer to a copysheet, and more particularly relates to an improvement for obtaining high accuracy in detecting a mark on the intermediate transfer member for accomplishing an accurate image registration for each of the colors.

2. Discussion of the Background

There is proposed in Japanese Laid-Open Patent Application Tokukaihei 5-150574 a color image forming apparatus having an intermediate transfer member to transfer thereupon images for a plurality of colors, such as cyan, magenta, yellow and black, which are carried on a surface of a photoconductor, sequentially superposing one image on top of another to form a full color image for further transfer to a copysheet. This apparatus includes a photoconductive element composed of a flexible endless belt or a drum with a photoconductive layer on its surface, a detector for detecting a position of the photoconductive element in its rotating direction, a latent image forming device for scanning a surface of the photoconductive element to form a latent image thereon, a developing device for sequentially developing a plurality of latent images for a corresponding plurality of colors, an intermediate transfer belt for temporarily holding thereupon a visible image which is transferred from the photoconductive element, and a detector for detecting a position of the intermediate transfer belt in its rotating direction. The photoconductive element includes one detection mark on its surface and the intermediate transfer belt includes a plurality of detection marks on its surface. The intermediate transfer belt is shaped in an endless belt configuration and is passed around a plurality of support rollers, and the plurality of marks are printed on the intermediate transfer belt longitudinally keeping a predetermined distance between the marks. For accomplishing an accurate image registration for each of the plurality of colors on the intermediate transfer belt, a start signal for image formation is output from the detector in accordance with a detect signal for a mark on the intermediate transfer belt.

In such a background color image forming apparatus as mentioned above, a detector detecting a mark on the intermediate transfer belt is positioned facing a part of the intermediate transfer belt in a position between the support rollers, and is not positioned to face a part of the belt which passes around the support rollers. A distance between the marks on the intermediate transfer belt, and thus an output of the detector, fluctuates easily in such a configuration due to a waving or a loosening of the intermediate transfer belt, and consequently an output timing of a detect signal for a mark fluctuates every time when detecting a mark. Therefore, there occurs a result that the images for each of the plurality of colors are not accurately registered with each other on the intermediate transfer belt.

To solve the above problem, an improved construction of an intermediate transfer belt is proposed as shown in FIGS. 1(*a*) and 1(*b*). A mark 23 on an intermediate transfer belt 10 is detected by a detector 22 at a position where the intermediate transfer belt 10 passes around a support roller 21. That is, the detector 22 is provided at a position facing the roller 21. Compared with a detect position as disclosed in Japanese Laid-open Patent Application Tokukaihei 5-150574 described above, a positional relation of the detector 22 to the mark 23 on the intermediate transfer belt 10 is stable in this device because a detect position of the belt 10 is not a part of the belt 42 where a waving occurs, but is a part of the belt 10 passing around and contacting the support roller 21.

However, an image forming apparatus generally includes various actuators for starting an operation of driving elements of the apparatus, such as, for example, a driving motor for driving a developing unit, a clutch for operating a feeding roller to feed a copysheet, a solenoid for starting an operation of a cleaning blade, and so forth. When an actuator starts or terminates an operation of such a moving element, some vibration occurs and, as a result, a positional relation of the detector 22 and a mark 23 on the intermediate belt 10 is changed from a normal condition to an abnormal condition. If such a deviation of the positional relation between the detector 22 and a mark 23 occurs while the detector 22 is detecting a mark 23, it occurs that the detector 22 does not detect mark 23 properly or that an output timing of a detect signal is deviated from an output timing of a preceding detect signal, and as a result, an image for each of a plurality of colors is not superposed accurately with each other on the intermediate transfer belt 10.

Further, the roller 21 around which the intermediate transfer belt 10 passes has generally some eccentricity itself due to inaccuracy of treatment, inaccuracy of assembling, or the like, and therefore, a positional relation of a surface of the intermediate transfer belt 10 to the detector 22 at a detect position changes with a rotation of the roller 21, see FIG. 1(*b*). Therefore, a distance between a mark 23 on the surface of the intermediate transfer belt 10 and the detector 22 also changes, see FIG. 1(*b*), and a detect timing for the mark 23 fluctuates every time when detecting the mark 23, thus causing disorder of an image registration for each of the plurality of colors.

In view of the above problems encountered in a presently available color image forming apparatus, it is highly desirable to provide a color image forming apparatus capable of accurately detecting a mark on an intermediate transfer belt for accomplishing an accurate image registration for each of a plurality of colors.

SUMMARY OF THE INVENTION

The present invention has been made in view of such problems, and accordingly one object of the present invention is to provide a novel color image forming apparatus capable of accomplishing an accurate image registration for each of a plurality of colors, even if a deviation of a positional relation between a mark on the intermediate transfer belt and a mark detector occurs due to a vibration caused by an operation of a moving element of the apparatus.

Another object of the present invention is to provide a novel color image forming apparatus capable of accomplishing an accurate image registration for each of a plurality of colors even if a positional relation of a mark on an intermediate transfer belt and a mark detector is deviated due to an eccentricity of a support roller around which the belt is passed.

In order to achieve the above-mentioned objects, a color image forming apparatus according to the present invention includes a photoconductive member. A latent image forming device forms a plurality of latent images for a corresponding plurality of colors sequentially on a surface of the photoconductive member. A developing unit develops each of the plurality of latent images on the photoconductive member sequentially with a toner of a corresponding color to produce corresponding visible images. An intermediate transfer belt transfers thereupon a visible images of the respective colors on the photoconductive member superposing one image on top of another to form a full color image. A mark is provided on the intermediate transfer belt to indicate a position of a part of the intermediate transfer belt. A detector detects the mark on the intermediate transfer belt to generate a detect signal. A first controller controls an image forming timing in accordance with a detect signal from the detector, and another second controller controls the detector to start detection of a mark when a predetermined length of time is elapsed after a start or a termination of an operation of a driving element of the apparatus.

Such a predetermined length of time is determined in accordance with a period of time during which an amount of a positional movement of the intermediate transfer belt or an amount of a positional movement of the detector, which is caused by an operation of one of the moving elements of the apparatus, is attenuated.

In accordance with another aspect of the present invention, a novel color image forming apparatus is provided with a controller for inhibiting a start or a termination of an operation of a driving element of the apparatus for a period of time during which the detector is detecting a mark on the intermediate transfer belt.

In accordance with yet another aspect of the present invention, a novel color image forming apparatus is provided with an intermediate transfer belt which is passed around a plurality of support rollers and a detector for detecting the mark on the intermediate transfer belt is placed at a position facing a part of the intermediate transfer belt being passed around one of the support rollers, and more particularly, a part of the intermediate transfer belt passing around a drive roller driving the intermediate transfer belt.

In accordance with another aspect of the present invention, a novel color image forming apparatus is provided with an intermediate transfer belt having a plurality of marks formed thereupon at equal spaces at a distance equal to a circumference, or an integral multiple of a circumference, of the support roller the detector faces.

In accordance with yet another aspect of the present invention, a novel color image forming apparatus is provided with a detector detecting the mark on the intermediate transfer belt at a predetermined interval of time and a controller determining that a mark is recognized when a predetermined number of successive detect signals are generated from the detector, and further, inhibiting such a judgment on recognition of a mark based on a number of successive detect signals for a predetermined period of time after the predetermined number of successive detect signals are generated.

In accordance with another aspect of the present invention, a novel color image forming apparatus is provided with a controller for determining that a mark is recognized if an interval between an output timing of a detect signal for one of the marks and an output timing of a detect signal for a following mark is within a predetermined range.

In accordance with yet another aspect of the present invention, a novel color image forming apparatus is provided with a device to inform an operator of the apparatus of an abnormal condition of the apparatus if the above-mentioned interval is out of the predetermined range. Further, the controller may terminate an operation of the apparatus in a case that the above-mentioned interval is out of the predetermined range.

In accordance with yet another aspect of the present invention, the controller further neglects the second detect signal if the above-mentioned interval is determined as being out of the predetermined range, and yet is determined as being within another predetermined range.

BRIEF DESCRIPTION OF THE DRAWINGS

A more complete appreciation of the present invention and many of the attendant advantages thereof will be better understood by reference to the following detailed description when considered in connection with the accompanying drawings, wherein.

DESCRIPTION OF THE PREFERRED EMBODIMENTS

Figure 1A:
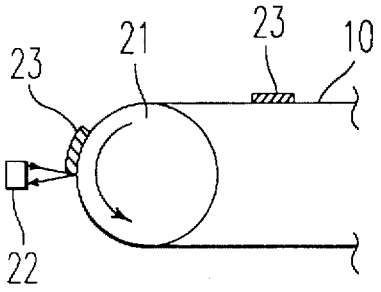
FIGS. 1(*a*) and 1(*b*) are illustrations showing examples of background arts related to the present invention.

The present invention will now be described in detail with respect to the accompanying drawings, in which like reference numerals represent identical or corresponding parts.

Figure 2:
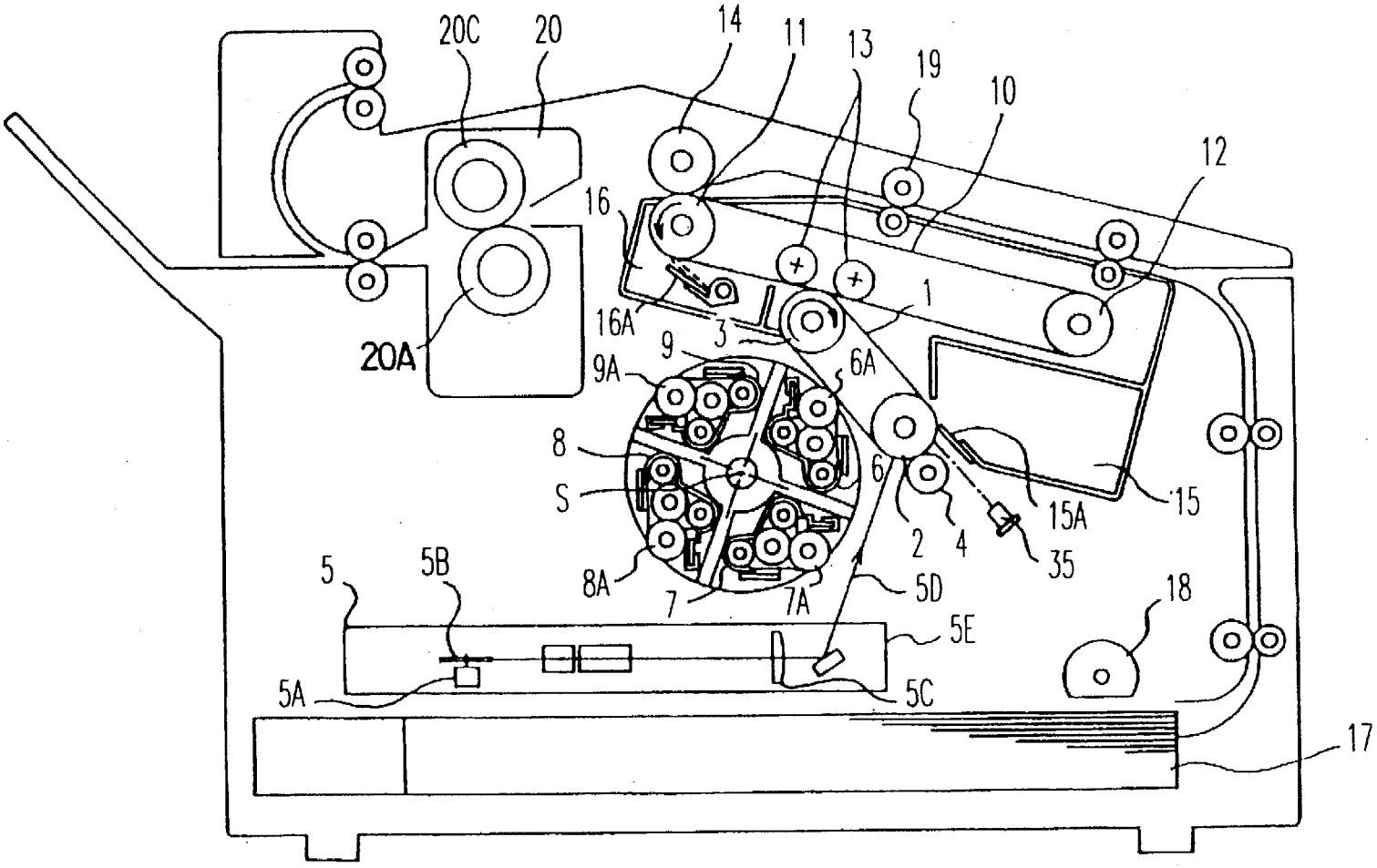
FIG. 2 is a schematic drawing showing an example of a color image forming apparatus related to the present invention.
Figure 3:
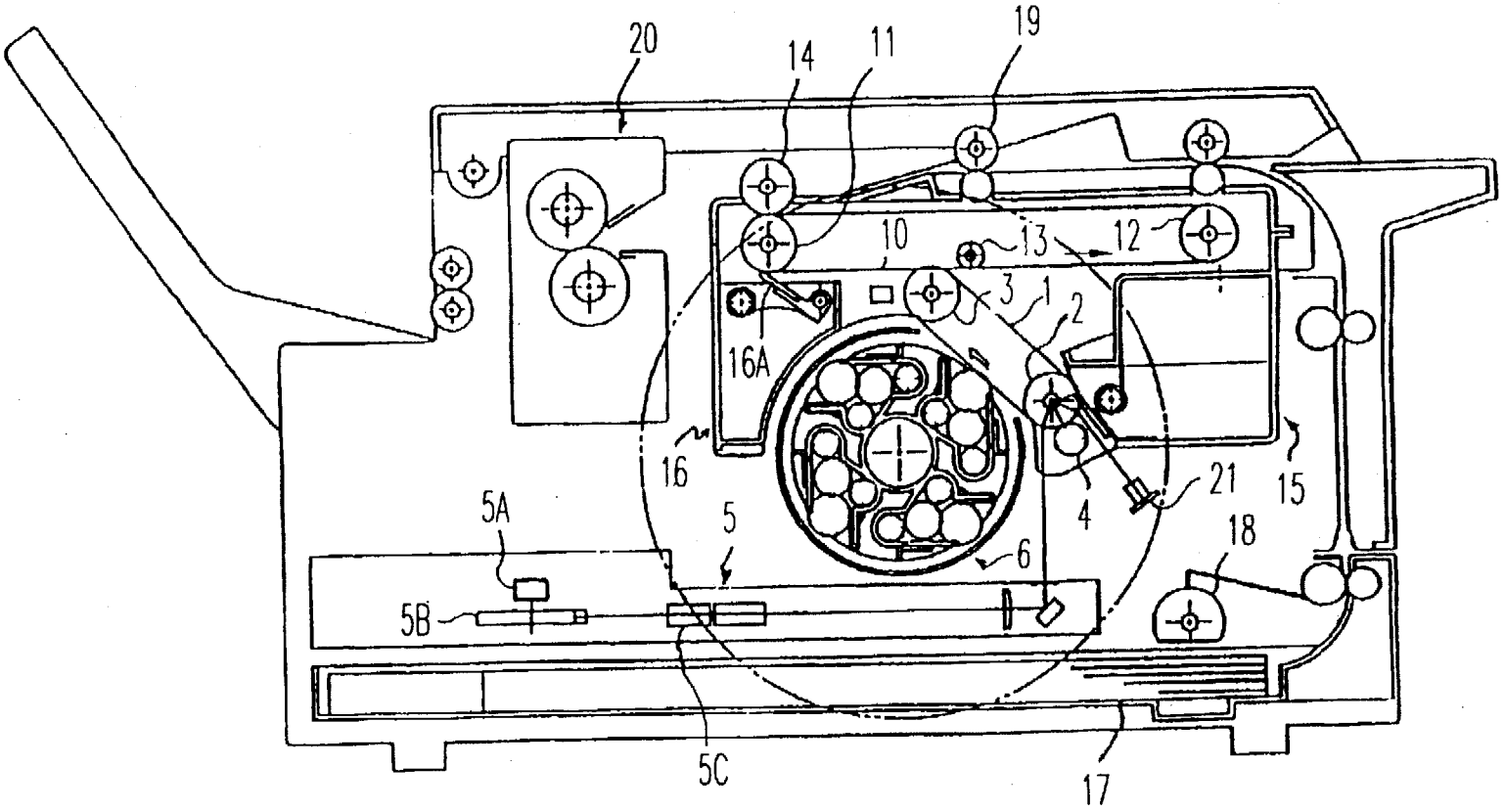
FIG. 3 is a schematic drawing showing another example of a color image forming apparatus related to the present intention.

FIGS. 2 and 3 illustrate respectively an example of a color image forming apparatus according to the present invention, and an embodiment of the present invention will be described referring to FIG. 2.

An image carrying element 1 made of an endless photoconductive belt is passed around rotating rollers 2 and 3, and is driven by the rollers 2 and 3 clockwise. Numeral 4 denotes a charging member which is placed in contact with the endless photoconductive belt 1, and numeral 5 denotes a laser writing unit which is an image exposing device to form a latent image on the photoconductive belt 1. The charging member 4 and the laser writing unit 5 constitute a latent image forming unit. Numerals 6 through 9 denote a plurality of developing devices, each storing respectively a corresponding color toner and integrally constituting a developing unit. Each of the developing devices 6–9 is integrated with each other, and is placed along a periphery of a shaft S to rotate integrally. The laser writing unit 5 is accommodated in a casing 5E which has a slit for exposure on a top thereof and is assembled in a main body of the apparatus. The laser writing unit 5 may be replaced with an optical system which integrates a light emitting portion and a converging light transmitting element in one body. The charging member 4, a laser beam 50 and a cleaning unit 15 for cleaning a surface of the photoconductive belt 1 are provided at the side of the roller 2, which is one of the rollers around which the photoconductive belt 1 is passed.

Each of the developing devices 6–9 stores toner for a respective color, for example, yellow toner, magenta toner, cyan toner, and black toner. The developing devices 6–9 include developing sleeves 6A–9A respectively which adjoin or contact the photoconductive belt 1 at a predetermined position to convert a latent image formed on the photoconductive belt 1 into a corresponding toner image.

Numeral 10 denotes an intermediate transfer element to transfer thereupon a toner image formed on the photoconductive belt 1 and to carry thereupon the transferred image to further transfer the image to a copysheet. The intermediate element 10 is shaped in an endless belt-shaped configuration and is passed around rotating rollers 11 and 12 to be driven counterclockwise. The intermediate transfer belt 10 includes on its surface at least one indicator to indicate a position of a part of the belt.

The photoconductive belt 1 contacts the intermediate transfer belt 10 at a portion of the rotating roller 3, and a first visible image on the photoconductive belt 1 (for example, a yellow toner image) is transferred to the intermediate transfer belt 10 by applying a transfer bias with a bias roller (a first transfer roller) 13. This procedure is repeated to transfer a second visible image (for example, a magenta toner image), a third visible image (for example, a cyan toner image), and a fourth visible image (for example, a black toner image) to the intermediate transfer belt 10 sequentially, one over the other, keeping a registration of each image.

A transfer roller 14 (a second transfer roller) is placed at a position outside of the rotating roller 11 so as to move apart from and contact the intermediate transfer belt 10. The transfer roller 14 comes in contact with the intermediate transfer belt 10 when transferring a visible image to a copysheet in full colors which is produced by the four transfer processes on the intermediate transfer belt 10. Numeral 15 is a cleaning device for cleaning a surface of the photoconductive belt 1, and numeral 16 is a cleaning unit for cleaning a surface of the intermediate transfer belt 10. A blade 16A of the cleaning unit 16 is usually separated from a surface of the intermediate transfer belt 10, and after an image on the intermediate transfer belt 10 is transferred, the blade 16A is pressed against the intermediate transfer belt 10 for removing the toner remaining thereupon.

Figure 4:
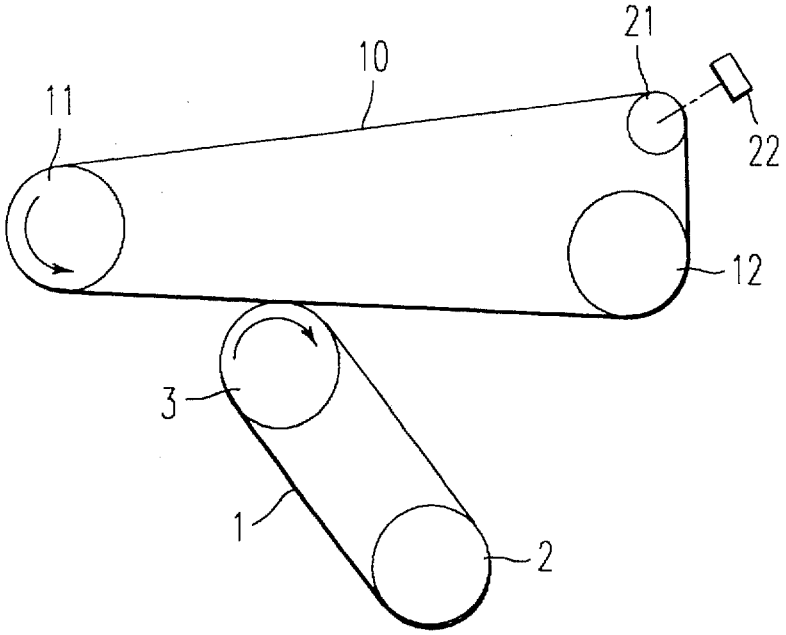
FIG. 4 is a schematic view showing an intermediate transfer belt and a photoconductive belt of a color image forming apparatus related to the present invention.

Although FIG. 2 shows an example of the intermediate transfer belt 10 being supported by two rotating rollers 11 and 12, three or more rollers 11, 12, 21 may be provided as shown as an example in FIG. 4.

Figure 1B:
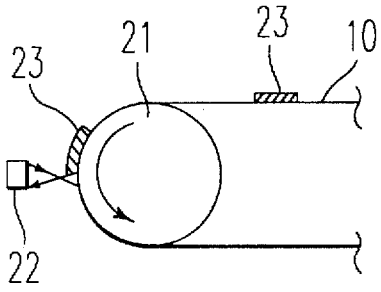

As shown in FIG. 4, a detector 22 for detecting a mark on the intermediate transfer belt 10 is provided at a position facing one of the rollers 11, 12 and 21 around which the intermediate transfer belt 10 is passed (although not shown in FIG. 1). The detector 22 is, for example, a photosensor and detects a mark 23 on the intermediate transfer belt 10.

Further, a color image forming apparatus according to the present invention includes a control device (not shown in FIGS. 1 and 2), constituting a latent image forming control to control a latent image forming timing for respective colors (an image writing timing for respective colors) in accordance with a detect signal from the detector 22. The control device further constitutes a control to control a detect timing of the detector 22.

Further, the apparatus includes a communication device (not shown in FIGS. 1 and 2) including an operational display panel to inform an operator of the apparatus of various conditions of the apparatus.

A color image forming process of a color image forming apparatus with the aforementioned construction is performed as described below. First, an image of an original document is read by an image reading device, which is an independent device from the image forming apparatus in this embodiment and is not shown in the drawings. An image is read by a device such as, for example, a charge coupled device, which is provided in the image reading device. Image data thus obtained, after an A/D conversion and other necessary processing are applied, are processed by an image data processing unit and are stored in an image memory temporarily.

When recording an image, a control device of the image reading device or a control device of the color image forming apparatus outputs image data, which is stored in the aforementioned image memory, to a recording device, such as, for example, an image forming device of a color image forming apparatus shown as an embodiment in FIG. 2. When color image data which is obtained from the image reading device is input into the aforementioned laser writing unit 5, a laser beam, which corresponds to image data for a corresponding color, is emitted from a laser diode (not shown in the drawings), and the laser beam is scanned rotationally by a polygon mirror 5B which is rotated by a drive motor 5A. Further, the laser beam is transmitted through a f-theta lens 5C, after the optical path is bent by a reflection of a mirror, to a surface of the photoconductive belt 1. The photoconductive belt 1 has been first discharged by a lamp 35 and is then uniformly charged by the charging member 4, and a latent image is formed by exposing the aforementioned laser beam on a peripheral surface of the photoconductive belt 1.

A latent image formed on the photoconductive belt 1 is an exposed image pattern for a monocolor image which is produced by separating a desired full color image into separate colors, such as yellow, magenta, cyan and black. Each latent image formed on the photoconductive belt 1 is developed into a visible monocolor image by one of the developing devices 6–9 which includes a corresponding color toner. Each color image of yellow, magenta, cyan and black formed on the photoconductive belt 1 is transferred onto the intermediate transfer belt 10 sequentially superposed with each other. A final image thus formed on the intermediate transfer belt 10 is then transferred onto a copysheet by the transfer roller 14. The copysheet is then transported to a transfer section from a paper support 17, via a feeding roller 18 and a registration roller 19. A color image on the intermediate transfer belt 10 is transferred to a copysheet by applying a transfer bias to the transfer roller 14 which is generated from a transfer charger unit (not shown in the drawings). Subsequently, a full color image on the copysheet is fixed by a fixing unit 20.

Although the photoconductive element of the embodiment shown in FIGS. 2 and 3 is shaped in a belt configuration, the photoconductive element may be shaped in a drum configuration. Further, the developing unit including a plurality of developing devices for respective color toners may be held for linear horizontal or vertical movement relative to the photoconductive element, or may be located fixedly relative to the photoconductive element. Further, a cleaning unit may be shaped in a roller-like shape or a brush-like shape.

Figure 5:
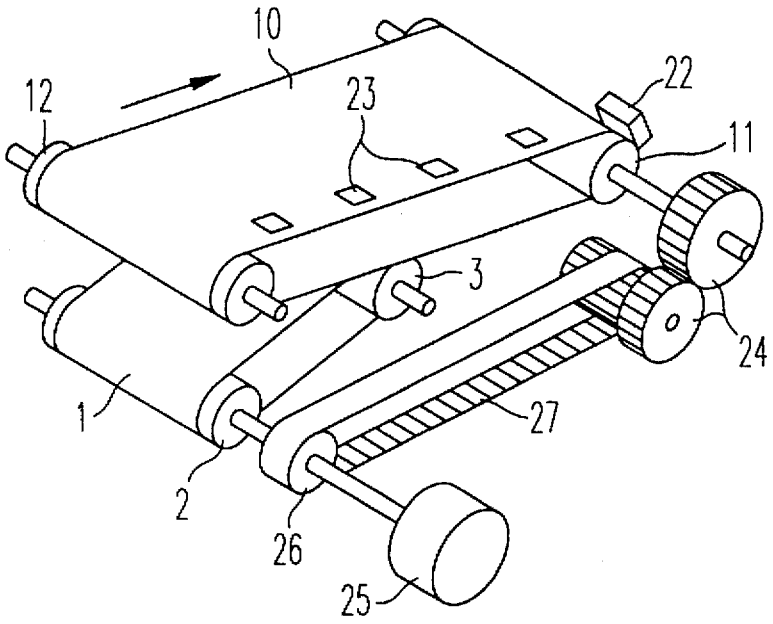
FIG. 5 is another schematic view showing an intermediate transfer belt and a photoconductive belt of a color image forming apparatus related to the present invention.

FIG. 5 is an enlarged perspective view of a part of a color image forming apparatus. The photoconductive belt 1 is rotated at a uniform velocity by rotation of a rotating roller 2 which is driven by a drive motor 25. A pulley 26 is provided between the drive motor 25 and the rotating roller 2, and the pulley 26 drives a timing belt 27 and a gear 24 provided on an end of the timing belt 27. The gear 24 is connected to a rotating roller 11 via a rotating shaft, and the gear 24 drives the roller 11, and further, the roller 11 drives an intermediate transfer belt 10 at a uniform velocity.

Marks 23, which have a different reflectance from that of the intermediate transfer belt 10, are printed on the intermediate transfer belt 10, and an output timing of a laser writing signal is determined in accordance with a timing of detecting marks 23 with an optical mark detect device 22.

In this embodiment, it is assumed that eight mark portions 23 with a 10 mm width are printed at equal spaces on the intermediate transfer belt 10 having a circumferential length of 400 mm. A linear velocity of the intermediate transfer belt 10 is presumed as 100 mm/sec.

Figure 6:
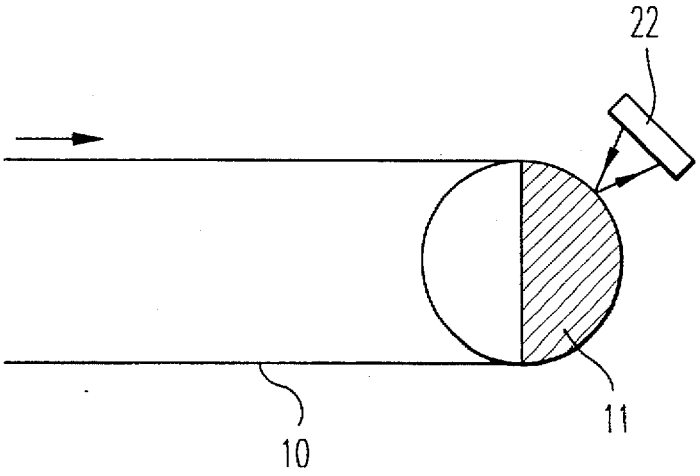
FIG. 6 is a schematic view showing a positional relation between an optical mark detector and an intermediate transfer belt.

Further, the optical mark detect device 22 is provided at a position facing a part of the intermediate transfer belt 10 passing around the roller 11 driving the intermediate transfer belt 10 for detecting marks 23 on the intermediate transfer belt 10, as shown in FIG. 6. By positioning the detect device 22 in such a position, it is avoided that a timing of detecting the mark 23 is deviated every time when detecting due to a waving or a loosening of the intermediate transfer belt 10. The optical detect device 22 may also be positioned facing a part of the intermediate transfer belt 10 passing around the driven roller 12.

Figure 7:
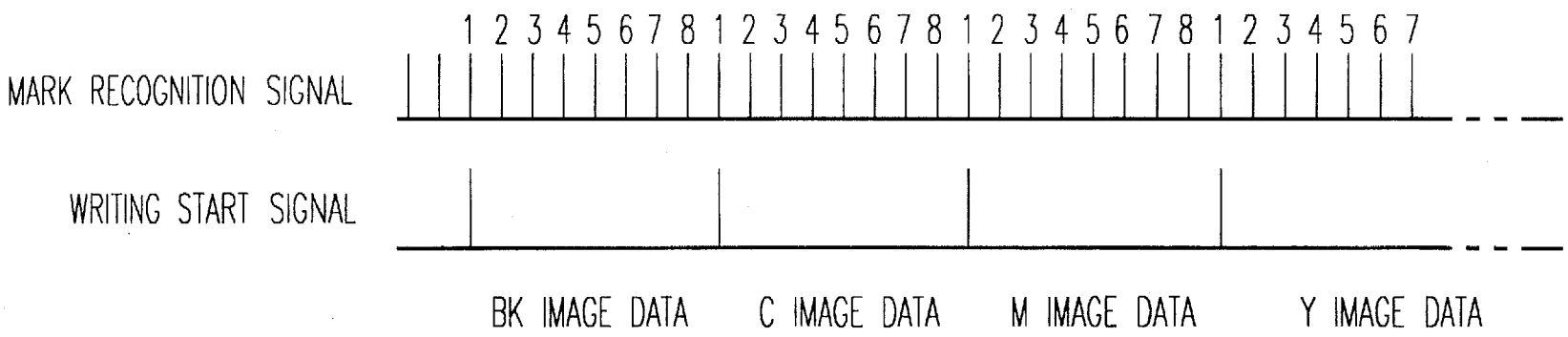
FIG. 7 is an illustration explaining a relation of a mark detect signal and an image writing start signal of a color image forming apparatus related to the present invention.

FIG. 7 illustrates a relation between a mark recognition signal and an image writing start signal. As shown in FIG. 7, an image writing start signal for a particular color is generated when the same mark, which is recognized for the preceding image writing cycle, is recognized.

Figure 8A:
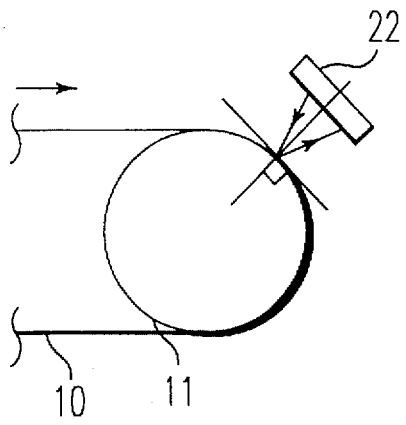
FIGS. 8(*a*) and 8(*b*) are illustrations explaining a positional relation between an optical mark detector 22 and a support roller 11.
Figure 8B:
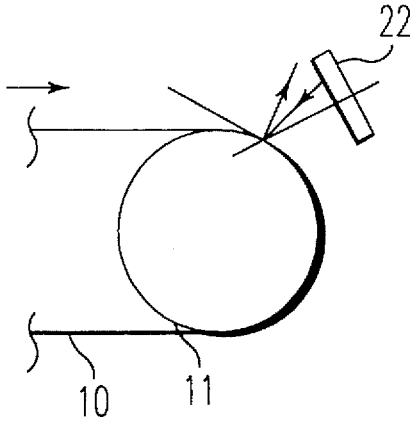

Generally, an image forming apparatus includes various actuators for starting an operation of a driving element of the apparatus, such as, for example, a driving motor for driving a developing unit (not shown in the drawings), a clutch (not shown in the drawings) for operating the feeding roller 18, a solenoid (not shown in the drawings) for starting an operation of the cleaning blade 16A, and so forth. When such an actuator starts or terminates an operation of a driving element of the apparatus, some vibration occurs, and there is a possibility that a positional relation of the optical detect device 22 and a support roller 11 the detect device 22 faces is changed from a normal condition as shown in FIG. 8(*a*) to an abnormal condition as shown in FIG. 8(*b*). If such a deviation of the positional relation between the optical mark detect device 22 and the support roller 11 occurs when the detect device 22 starts detection of a mark 23, it occurs that the optical mark detect device 22 does not detect mark 23 properly, or a timing of a detection is deviated from a timing of a detection in a normal condition. As a result, an output timing of a detect signal for the mark 23 for each of a plurality of colors fluctuates, and as a result, an image of each color is not superposed accurately.

Further, the cleaning blade 16A contacts or separates from the drive roller 11 as shown in FIG. 2, and therefore, depending on a condition of the cleaning blade 16A, a velocity of the intermediate transfer belt 10 may fluctuate. Therefore, the positional relation between the mark 23 on the intermediate transfer belt 10 and the optical detect device 22 may be fluctuated even if a deviation of the positional relation between the detect device 23 and the support roller 11 as described above does not occur as a result of an operation of an actuator.

Figure 9:
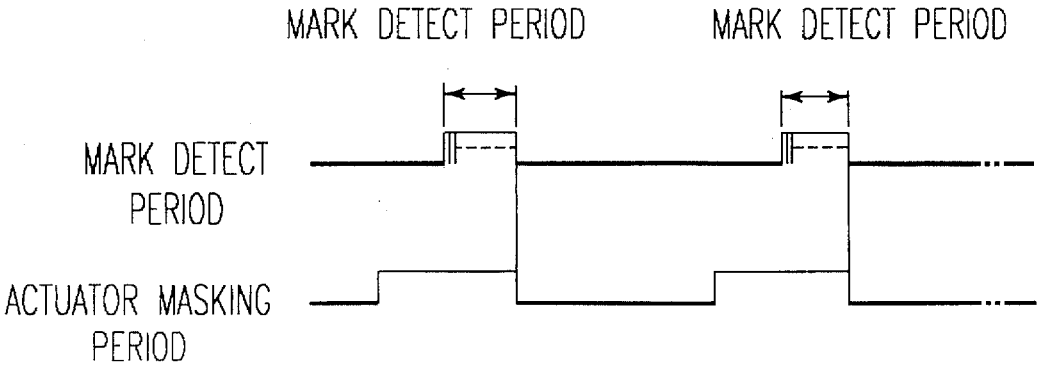
FIG. 9 is an illustration explaining a relation between a mark detect signal and an actuator masking period.

Accordingly, assuming that a vibration due to a start or a termination of an actuator operation is attenuated in about 0.08 second, an apparatus according to the present invention is so controlled that a start or a termination of an actuator operation is not executed after the optical mark detect device 22 detects a position 10 mm from the edge of a neighboring mark until the detect device 22 detects the end of the mark as shown in FIG. 9. Such a masking period for masking an operation of an actuator for each of eight marks 23 is not required to be kept constant and may be different.

Next, a process of a mark recognition is explained. In this embodiment, a sampling frequency for a mark detection is set to 1 KHz, and it is determined that a mark 23 is recognized when a mark part is detected a predetermined number of times (for example, five times) successively after a non-mark part is detected the same predetermined number of times (for example, five times) successively. Therefore, it is not determined that a mark 23 is recognized in a case that only one or two detect signals, for example, are generated. Thus, it is avoided that a stain of toner or a rip on the intermediate transfer belt 10 is erroneously judged as a mark 23.

Figure 10:
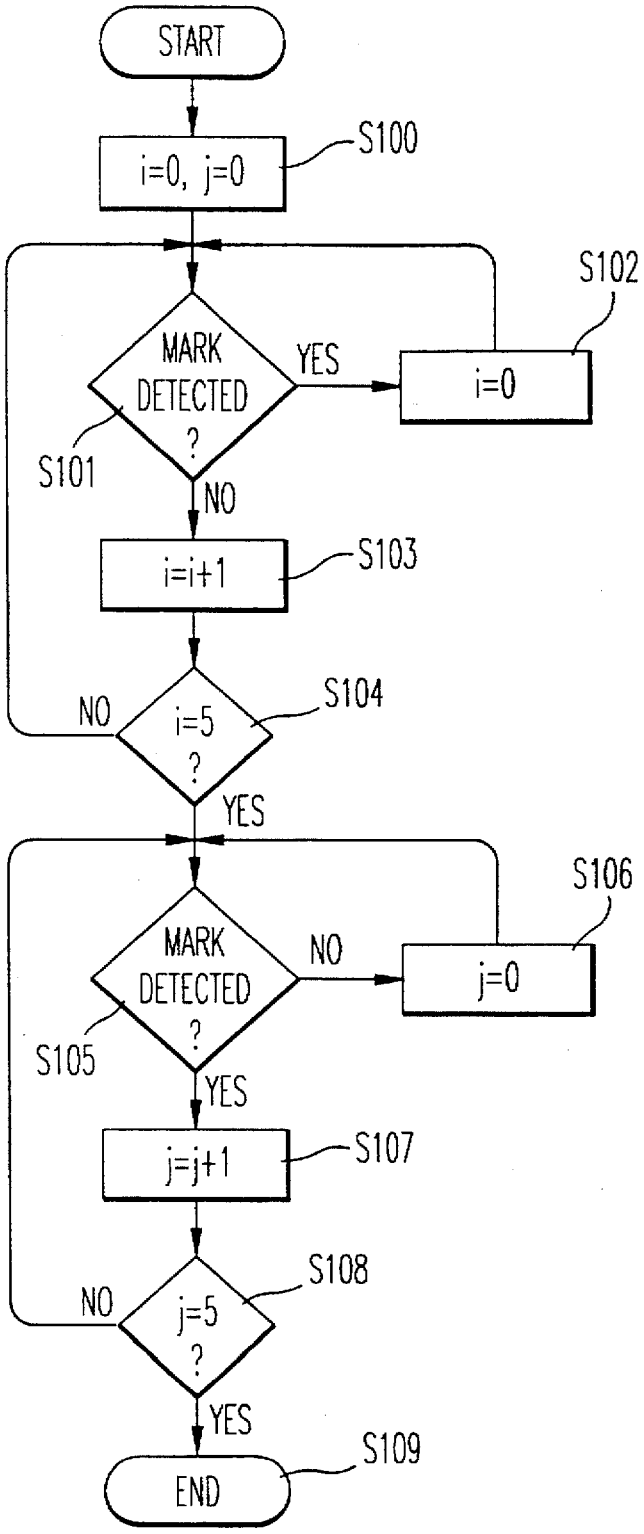
FIG. 10 is a flow chart showing a process of a mark recognition.

FIG. 10 is a flow chart illustrating a process of a mark recognition. A counter i for counting pulses for a non-mark area and a counter j for counting pulses for a mark area are reset at first (step S100). A CPU of a control system, see FIG. 16, determines whether or not the optical mark detect device 22 has detected a mark area (step S101). If the answer is YES in step S101, the CPU resets the counter i (step S102). Then, the program returns to the step S100. The CPU repeats the step 101 until the optical detect device 22 detects a non-mark area. When the optical detect device 22 detects a non-mark area, the CPU increments the counter i to "i=i+1" (step S103). Subsequently, the CPU determines whether or not the counter i has been incremented to "5" (step S104). If the answer is NO in step S104, the program returns to the step S101, and the CPU repeats the step S104 until the counter i increments to 5. When the counter i reaches 5, the CPU determines whether or not the optical detect device 22 has detected a mark area. If the answer is NO in step S105, the CPU resets the counter j (step S106). Then, the program returns to the step S105. The CPU repeats the step S105 until the optical detect device 22 detects a mark area. When the optical detect device 22 detects a mark area, the CPU increments the counter j to "j=j+1" (step S107).

Subsequently, the CPU determines whether or not the counter j has been incremented to "5" (step S108). If the answer is NO in step S108, the program returns to step S105, and the CPU repeats to step S108 until the counter j increments to 5. If the counter j has been incremented to "5", it is determined that a mark 23 is recognized and the program ends.

Figure 11:
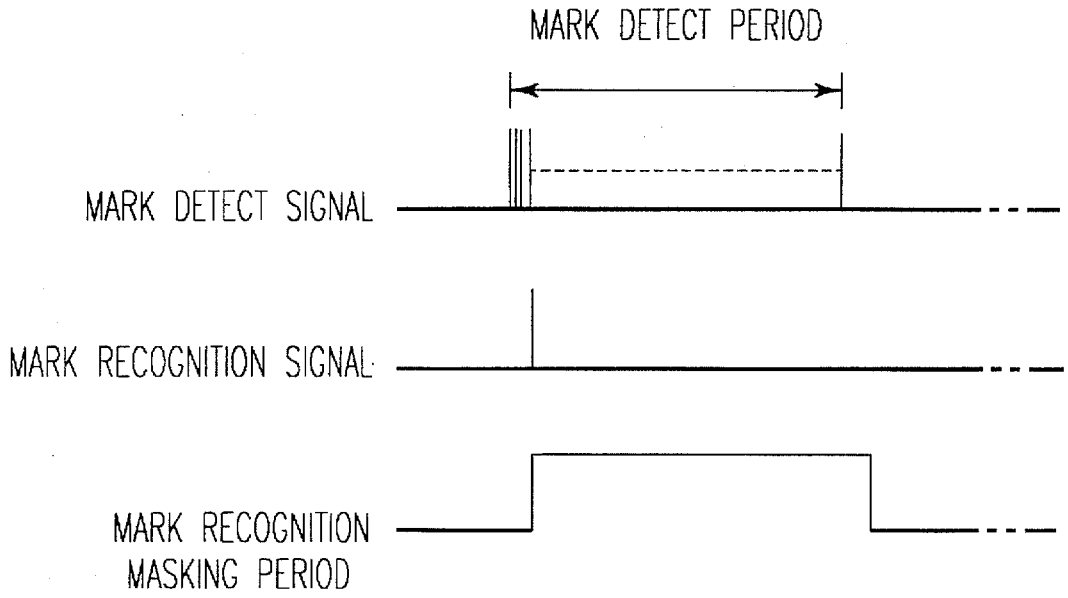
FIG. 11 is an illustration explaining a relation among a mark detect signal, a mark recognition signal and a mark recognition masking period.
Figure 12:
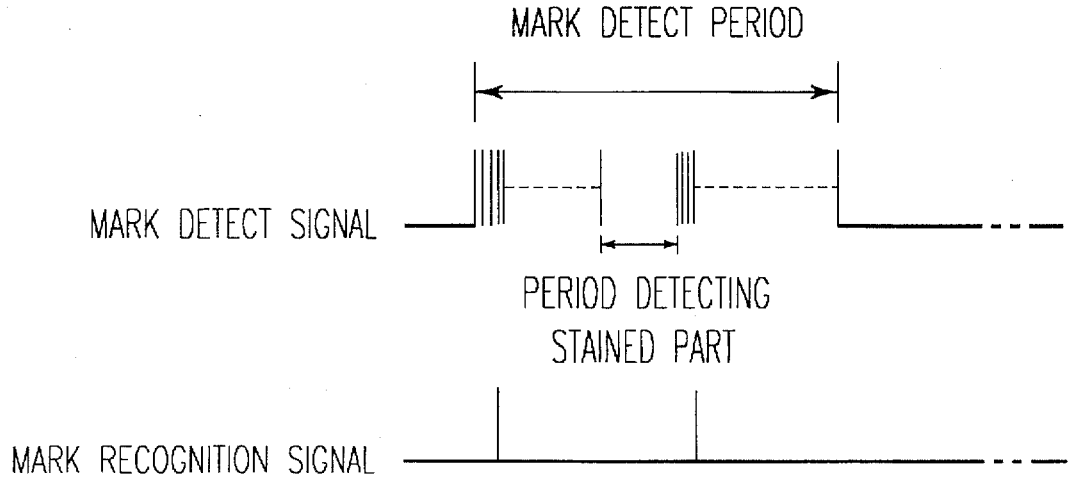
FIG. 12 is an illustration explaining an example of judging a stained area of a mark as another mark.

Further, a predetermined period of time after recognizing a mark (for example, 0.1 second) is set as a period for masking a mark recognition process as shown in FIG. 11. Accordingly, it is avoided that a stain area in a mark part is judged as another mark as shown in FIG. 12 and that two mark recognition signals are generated from one mark. Still further, the masking period for the mark recognition process is set to a period of time which is at least shorter than a period of time that the intermediate transfer belt 10 moves from a position where a first mark is detected to a position where a second mark which immediately follows the first mark is detected.

Still further, when a mark 23 on the intermediate transfer belt 10 is smeared with toner or a surface of the belt 10 is scratched when a toner image for a particular color is transferred thereupon from the photoconductive belt 10, there is a possibility that the detector 22 detects a part of such a stain, and that an output timing of a mark detect signal, and consequently an output timing of a mark recognition signal to start an image formation operation for a next color, is deviated from an output timing of a mark recognition signal for a previous color. If such a deviation in the output timing of the mark recognition signal occurs, a deviation in superposing one image on top of another results. Therefore, an output timing of a mark recognition signal is checked if it is in a predetermined range of time after an output of a preceding mark recognition signal.

For example, when the color image forming apparatus starts an operation, a CPU of the control device starts reading count data for a mark detect signal which is generated by the aforementioned optical mark detect device 22 and stores in a memory count data for a detect signal in accordance with which a mark recognition signal is output. Further, the CPU stores in the memory count data for a detect signal in accordance with which a second mark recognition signal immediately following the first mark recognition signal is output. The CPU calculates the remainder of the count data for each of the first and second mark recognition signals, and checks if the remainder is within a predetermined range of numbers. If the remainder of the count data is outside of the predetermined range of numbers, the mark recognition is determined as an error, and an error message is displayed in an operational display of the apparatus to inform an operator of the error.

In this embodiment, since the distance between a leading end of a first mark to a leading and of a second mark is 50 mm and the counting frequency is set to 1 KHz, the remainder of the count data for the first and the second mark recognition signals must be within 400–600 counts. When the remainder of the aforementioned count data is out of such a predetermined range of numbers, an operation of the color image forming apparatus may be stopped. Further, when the remainder of the count data is extremely small (for example, about 20 counts), the data may be neglected, even though the aforementioned remainder of the count data is out of a predetermined range of numbers, so that a needless interruption of an operation resulting from a detection of a slight noise is avoided.

Further, according to the present invention, a distance between adjoining marks 23 may be made equal to a circumference or an integral multiple of a circumference of a rotating roller around which the intermediate transfer belt 10 is passed and which the optical detect device 22 faces.

Figure 13:
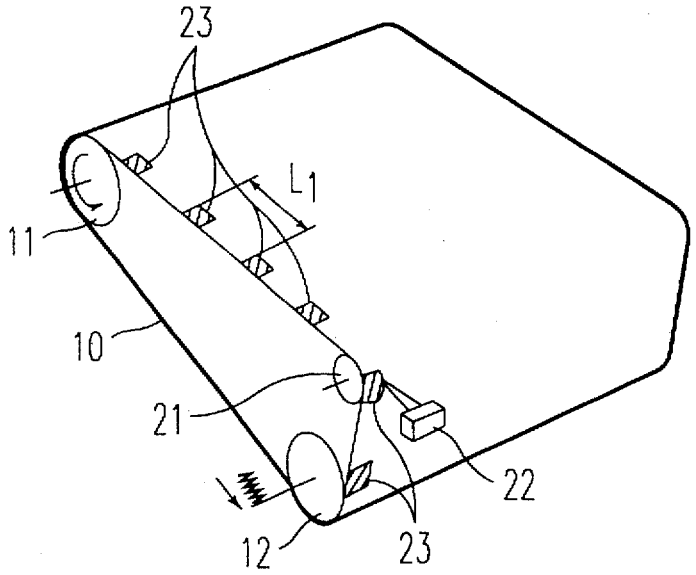
FIG. 13 is a perspective view of the intermediate transfer belt shown in FIG. 4.

FIGS. 4 and 13 illustrate an embodiment of the present invention wherein an optical mark detect device 22 for detecting a mark 23 on the intermediate transfer belt 10 is provided at a position facing a roller 21, which is one of the rotating rollers around which the intermediate transfer belt 10 is passed. A distance L1 between the adjoining marks 23 on the intermediate transfer belt 10 is made to equal to a circumference or an integral multiple of a circumference ($\pi \times d1$) of the roller 21 whose diameter is d1 as shown in the following equation.

$L1=A\times(\pi\times d1)$, in which

A: integral number d1: the diameter of the roller 21

By making the distance L1 between the adjoining marks 23 equal to a circumference or an integral multiple of a circumference of the rotation roller 21 as described above, the position of the intermediate transfer belt 10 to be passed around the rotation roller 21 is always kept the same, and accordingly, the distance between a mark 23 on the intermediate transfer belt 10 and the detect device 22 is always approximately the same, even if a positional relation between a surface of the intermediate transfer belt 10 and the optical mark detect device 22 may fluctuate in accordance with rotation of the roller 21 due to an eccentricity of the roller 21. Therefore, an output timing of a detect signal for the mark 23 is always kept the same, and accordingly, an image forming timing for each of a plurality of colors is controlled to be constant, even if the rotating roller 21 is eccentric.

Figure 14:
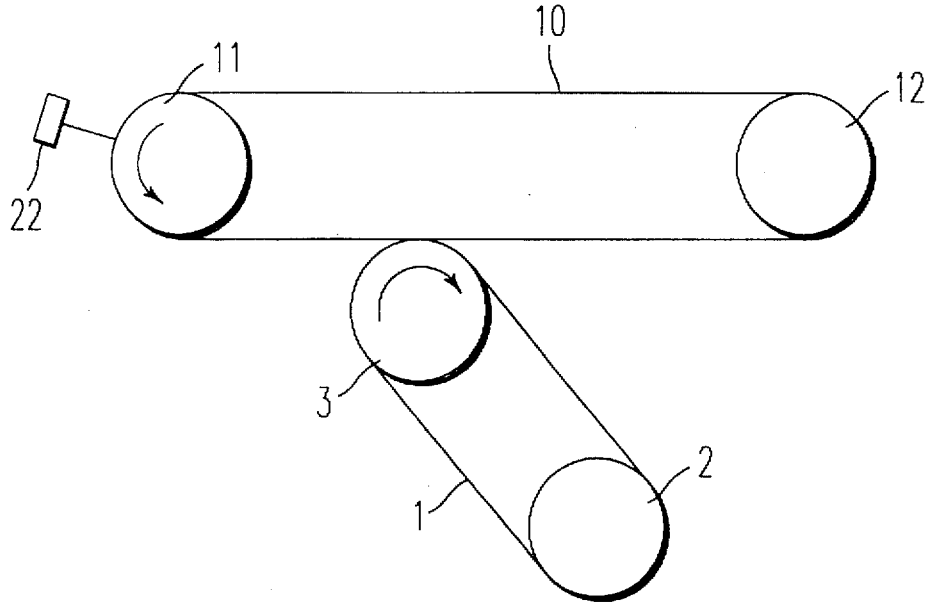
FIG. 14 is a schematic view showing an intermediate transfer belt and a photoconductive belt of another embodiment related to the present invention.
Figure 15:
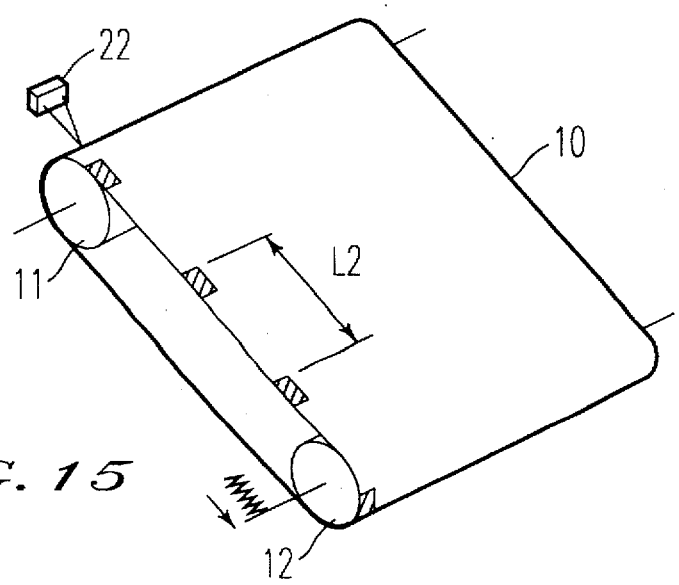
FIG. 15 is a perspective view of the intermediate transfer belt shown in FIG. 14.

Further, as shown in FIGS. 14 and 15, the optical mark detect device 22 for detecting a mark 23 on the intermediate transfer belt 10 may be positioned to face the drive roller 11 for the intermediate transfer belt 10. A distance L2 between the adjoining marks 23 on the intermediate transfer belt 10 is made equal to a circumference or an integral multiple of a circumference ($\pi \times d2$) of the drive roller 11 whose diameter is d2 as shown in following equation.

$L2=B\times(\pi\times d2)$, in which

B: integral number d2: the diameter of drive roller 11

Since an axis of the drive roller 11 is supported by a driving shaft, a position of the roller 11 does not move, while other rotation rollers (such as a tension roller) have some possibility of moving. Therefore, it is preferable to place the optical mark detect device 22 facing the drive roller for the intermediate transfer belt 10 for accomplishing a stable detection of a mark 23 on the intermediate transfer belt 10.

Figure 16:
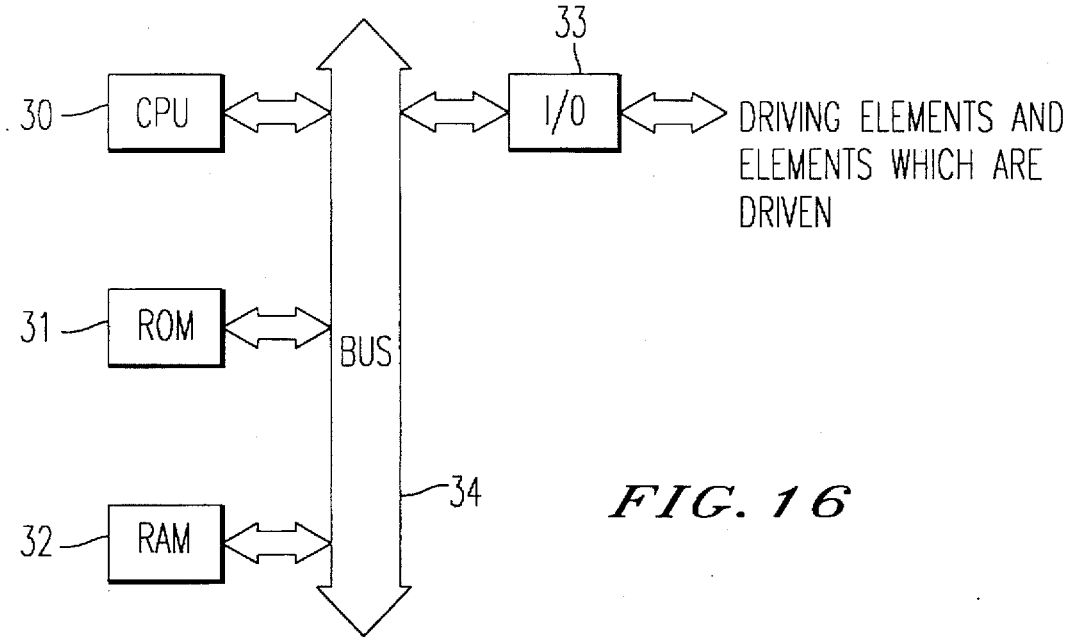
FIG. 16 is a block diagram showing an example of a structure of a control device of a color image forming apparatus according to the present invention.

FIG. 16 is a block diagram showing a control device of a color image forming apparatus according to the present invention. The control device may be a micro computer which includes a central processing unit (CPU) 30 performing various judgments, processings and controls, as discussed above, a ROM 31 which stores various programs, including programs for controlling a timing of forming a latent image and a timing of a detection with the detector 22, a RAM 32 for storing various processing data and an input and output circuit 33, each connected to a BUS 34. As discussed above, the control device receives various signals from various sensors provided at various parts of the apparatus for performing an image forming operation, various signals for designating various conditions of an image forming operation, prescribed by an operator, and signals from the detector 21, and then outputs to various driving devices and elements various signals for driving the driving devices at a prescribed timing, including a signal to start a latent image forming operation and a signal to start a detection for a mark.

The application of the present invention is not limited only to the embodiments described herein, but the present invention is also applicable to image forming apparatuses of various types which utilize the technical idea of this invention. A position, a shape, a number of the marks 23 on the intermediate transfer belt 10 may be changed, according to a requirement, and the optical mark detect device 22 may be an optical transmission type, an optical reflection type, or any type other than optical types, and further, the number and the location of the rollers around which the intermediate transfer belt 10 passes may be also changed. Further, not only a belt shaped image carrying element but also a drum shaped image carrying element is applicable. Further, the present invention is applicable not only for a color laser printer but also for a color copying machine and a color facsimile machine.

Obviously, numerous additional modifications and variations of the present invention are possible in light of the above teachings. It is therefore to be understood that within the scope of the appended claims, the present invention may be practiced otherwise than as specifically described herein.

What is claimed as new and desired to be secured by Letters Patent of the United States is:

1. A color image forming apparatus comprising:

a rotating image carrying element;

a latent image forming means for sequentially forming a plurality of latent images for a corresponding plurality of colors on said image carrying element;

a developing means for developing each of said plurality of latent images on said image carrying element into a respective plurality of visible images;

an intermediate transfer element held movably to transfer thereupon said plurality of visible images from said image carrying element superposing one visible image on top of another;

an indicator provided on said intermediate transfer element to indicate a position of said intermediate transfer element;

a detector provided adjacent to a moving course of said intermediate transfer element for detecting said indicator on said intermediate transfer element;

a latent image forming control means for determining if said indicator on said intermediate transfer element is recognized in accordance with a detect signal of said detector and to control said latent image forming means to start a latent image formation upon determining that said indicator is recognized;

a control means to control said detector to start detection of said indicator on said intermediate transfer element when a predetermined length of time has elapsed after a start and a termination of an operation of one of a plurality of driving elements of the apparatus.

2. The color image forming apparatus according to claim 1, wherein said predetermined length of time is a period of time during which an amount of a positional movement of said intermediate transfer element or an amount of positional movement of said detector, which is caused by said operation of one of said plurality of driving elements, becomes less than a predetermined amount.

3. The color image forming apparatus according to claim 2, wherein said developing means includes a plurality of devices each containing respective toner for the corresponding plurality of colors, such developing means being held for rotation relative to said image carrying element, and said operation of one of said plurality of driving elements of said apparatus is an operation of rotating said developing means.

4. A color image forming apparatus according to claim 2, further comprising cleaning means for cleaning a surface of said intermediate transfer element, said cleaning means being movable between a first position in contact with a surface of said intermediate transfer element and a second position apart from the surface of said intermediate transfer member, and said operation of one of said plurality of driving elements of said apparatus being an operation of moving said cleaning means between said first and second positions.

5. A color image forming apparatus according to claim 2, further comprising feeding means for feeding a transfer medium to transfer the visible image carried on said intermediate transfer element to the transfer medium, and said operation of one of said plurality of driving elements of said apparatus being an operation of said feeding means to feed said transfer medium.

6. A color image forming apparatus comprising:

a rotating image carrying element;

a latent image forming means for sequentially forming a plurality of latent images for a corresponding plurality of colors on said image carrying element;

a developing means for developing each of said plurality of latent images on said image carrying element into a respective plurality of visible images;

an intermediate transfer element held movably to transfer thereupon said plurality of visible images from said image carrying element superposing one visible image on top of another;

an indicator provided on said intermediate transfer element to indicate a position of said intermediate transfer element;

a detector provided adjacent to a moving course of said intermediate transfer element for detecting said indicator on said intermediate transfer element;

a latent image forming control means to determine if said indicator on said intermediate transfer element is recognized in accordance with a detect signal of said detector and to control said latent image forming means to start a latent image formation upon determining that said indicator is recognized; and a control means for inhibiting a start and a termination of an operation of one of a plurality of driving elements of said apparatus during a period of said detector detecting said indicator on said intermediate transfer element.

7. The color image forming apparatus according to claim 6, wherein said developing means includes a plurality of devices each containing respective toner for the corresponding plurality of colors, said developing means being held for rotation relative to said image carrying element, and said operation of one of said plurality of driving elements of said apparatus is an operation of rotating said developing means.

8. The color image forming apparatus according to claim 6, further comprising cleaning means for cleaning a surface of said intermediate transfer element, said cleaning means being movable between a first position in contact with a surface of said intermediate transfer element and a second position apart from the surface of said intermediate transfer element, and said operation of one of said plurality of driving elements of said apparatus being an operation of moving said cleaning means between said first and second positions.

9. A color image forming apparatus according to claim 6, further comprising feeding means for feeding a transfer medium to transfer the visible image carried on said intermediate transfer element to the transfer medium, and said operation of one of said plurality of driving elements of said apparatus being an operation of said feeding means to feed said transfer medium.

10. A color image forming apparatus comprising:

a rotating image carrying element;

a latent image forming means for sequentially forming a plurality of latent images for a corresponding plurality of colors on said image carrying element;

a developing means for developing each of said plurality of latent images on said image carrying element into a respective plurality of visible images;

an intermediate transfer element held movable to transfer thereupon said plurality of visible images from said image carrying element superposing one visible image on top of another, wherein said intermediate transfer element is composed of a belt member which is passed around a plurality of rollers including a drive roller to drive said intermediate transfer element;

an indicator provided on said intermediate transfer element to indicate a position of said intermediate transfer element;

a detector provided adjacent to a moving course of said intermediate transfer element for detecting said indicator on said intermediate transfer element wherein, said detector is provided at a position facing a part of said belt member passing around one of said rollers; and a latent image forming control means to determine if said indicator on said intermediate transfer element is recognized in accordance with a detect signal of said detector and to control said latent image forming means to start a latent image formation upon determining that said indicator is recognized;

wherein said belt member includes a plurality of said indicators, and a distance between two adjacent indicators is equal to an integral multiple of a circumference of said roller facing the detector.

11. The color image forming apparatus according to claim 10, wherein said detector is provided at the position facing a part of said belt member passing around said drive roller.

12. A color image forming apparatus comprising:

a rotating image carrying element;

a latent image forming means for sequentially forming a plurality of latent images for a corresponding plurality of colors on said image carrying element;

a developing means for developing each of said plurality of latent images on said image carrying element into a respective plurality of visible images;

an intermediate transfer element held movably to transfer thereupon said plurality of visible images from said image carrying element superposing one image on top of another, wherein said intermediate transfer element is composed of a belt member which is passed around a plurality of rollers;

a plurality of recognition indicators provided on said intermediate transfer element at equal spaces to indicate a position of said intermediate transfer element, wherein a distance of said equal spaces is equal to an integral multiple of at least one of a circumference of one of said rollers;

a detector provided adjacent to a moving course of said intermediate transfer element for detecting said indicator on said intermediate transfer element; and a latent image forming control means to determine if said indicator on said intermediate transfer element is recognized in accordance with a detect signal of said detector and to control said latent image forming means to start latent image formation upon determining that said indicator is recognized.

13. The color image forming apparatus according to claim 12, wherein said detector is provided at a position facing a part of said belt member passing around one of said rollers.

14. The color image forming apparatus according to claim 13, wherein said one of said rollers is a drive roller.

15. A color image forming apparatus comprising:

a rotating image carrying element;

a latent image forming means for sequentially forming a plurality of latent images for a corresponding plurality of colors on said image carrying element;

a developing means for developing each of said plurality of latent images on said image carrying element into a plurality of visible images;

an intermediate transfer element held movable to transfer thereupon said plurality of visible images from said image carrying element superposing one visible image on top of another;

an indicator provided on said intermediate transfer element to indicate a position of said intermediate transfer element, wherein said indicator provided on said intermediate transfer element is a mark formed on said intermediate transfer element;

a detector provided adjacent to a moving course of said intermediate transfer element for detecting said indicator on said intermediate transfer element, wherein said detector detects said mark on said intermediate transfer element at a predetermined interval of time; and a latent image forming control means to determine if said indicator on said intermediate transfer element is recognized in accordance with a detect signal of said detector and to control said latent image forming means to start a latent image formation upon determining that said indicator is recognized, wherein said latent image forming control means determines that said mark is recognized when a predetermined number of successive detect signals for said mark are output by said detector.

16. The color image forming apparatus according to claim 15, wherein said latent image forming control means inhibits performing a judgment on recognition of said mark for a predetermined period of time after said predetermined number of successive detect signals are output by said detector.

17. The color image forming apparatus according to claim 16, wherein said predetermined period of time is shorter than a period of time required for said intermediate transfer element to move from a first position where a first mark is detected by said detector to a second position where a second mark immediately following said first mark is detected by said detector.

18. A color image forming apparatus comprising:

a rotating image carrying element;

a latent image forming means for sequentially forming a plurality of latent images for a corresponding plurality of colors on said image carrying element;

a developing means for developing each of said plurality of latent images on said image carrying element into a respective plurality of visible images;

an intermediate transfer element held movably to transfer thereupon said plurality of visible images from said image carrying element superposing one visible image on top of another;

an indicator provided on said intermediate transfer element to indicate a position of said intermediate transfer element, wherein said indicator on said intermediate transfer element is a plurality of marks formed on said intermediate transfer element;

a detector provided adjacent to a moving course of said intermediate transfer element for detecting said indictor on said intermediate transfer element; and a latent image forming control means to determine if said indicator on said intermediate transfer element is recognized in accordance with a detect signal of said detector and to control said latent image forming means to start a latent image formation upon determining that said indicator is recognized, wherein said latent image forming control means determines an interval between an output timing of a detect signal for detecting a first one of said plurality of marks and an output timing of a detect signal for detecting a next or second one of said plurality of marks, determines if said interval is within a first predetermined range and determines that said first one of said plurality of marks is recognized if said interval is within said first predetermined range.

19. The color image forming apparatus according to claim 18, further comprising communication means to inform an operator of an abnormal condition of the apparatus, and wherein said latent image forming control means activates said communication means to inform the operator of the abnormal condition when said interval is determined as being outside of said first predetermined range.

20. The color image forming apparatus according to claim 18, wherein said control means terminates an operation of the apparatus when said interval is determined as being outside of said first predetermined range.

21. A color image forming apparatus according to claim 18, wherein said control means neglects said detect signal for said next or second one of said plurality of marks if said interval is determined as being outside of said first predetermined range and within a second predetermined range.

* * * * *